US008033035B2

(12) United States Patent
Brown et al.

(10) Patent No.: US 8,033,035 B2
(45) Date of Patent: Oct. 11, 2011

(54) STABILIZING AND SUPPORT ACCESSORY FOR STILETTO HEELS

(75) Inventors: Rebecca P. Brown, New York, NY (US); Monica F. Murphy, New York, NY (US)

(73) Assignee: Solemates, LLC, New York, NY (US)

( * ) Notice: Subject to any disclaimer, the term of this patent is extended or adjusted under 35 U.S.C. 154(b) by 788 days.

(21) Appl. No.: 12/120,585

(22) Filed: May 14, 2008

(65) Prior Publication Data

US 2009/0282702 A1 Nov. 19, 2009

(51) Int. Cl.

| | |
|---|---|
| ***A43B 21/37*** | (2006.01) |
| ***A43B 21/39*** | (2006.01) |
| ***A43B 21/42*** | (2006.01) |
| ***A43B 13/22*** | (2006.01) |

(52) U.S. Cl. ..... 36/72 B; 36/72 R; 36/36 R

(58) Field of Classification Search ..... 36/41, 92, 36/42, 34 B, 34 R, 24.5, 73, 82, 36 R, 58.6, 36/69, 76 HH, 62, 72 B, 72 R See application file for complete search history.

(56) References Cited

U.S. PATENT DOCUMENTS

| | | | | |
|---|---|---|---|---|
| 1,261,525 A | | 4/1918 | Helwitz | |
| 1,263,555 A | | 4/1918 | Helwitz | |
| 1,422,446 A | * | 7/1922 | Kaplan | 36/72 B |
| 1,820,679 A | * | 8/1931 | Sawyer | 36/72 B |
| 1,875,806 A | | 9/1932 | Givens | |
| 2,552,096 A | * | 5/1951 | Johnson | 36/70 R |
| 2,875,534 A | | 3/1959 | Grossman | |
| 3,035,357 A | * | 5/1962 | Valenti | 36/1 |
| 3,122,848 A | | 3/1964 | Grossman | |
| 3,439,435 A | | 4/1969 | Fredon | |
| 4,461,100 A | * | 7/1984 | Minor et al. | 36/72 B |
| 4,498,252 A | * | 2/1985 | Connors | 36/72 B |
| D299,883 S | | 2/1989 | Steele | |
| 5,044,097 A | * | 9/1991 | Young | 36/72 B |
| 7,730,638 B2 | * | 6/2010 | Urbach et al. | 36/72 B |
| 2007/0163149 A1 | | 7/2007 | Urbach et al. | |
| 2008/0196279 A1 | * | 8/2008 | Epping | 36/72 B |

* cited by examiner

*Primary Examiner* — Jila Mohandesi
*Assistant Examiner* — Melissa Lalli
(74) *Attorney, Agent, or Firm* — St. Onge Steward Johnston & Reens LLC

(57) ABSTRACT

A slip-on, slip-off stabilizing support accessory for a stiletto heel. The device is a unitary molding of semi-rigid, resilient plastic material formed with a generally hourglass configuration, with outwardly concave, resiliently flexible side walls for frictionally engaging opposite sides of a stiletto heel. An outwardly flared top opening facilitates application of the device to the heel, while an outwardly flaring bottom configuration provides a greatly enlarged ground contact area. Front and back edges of the side walls are of outwardly concave shape. Front and back wall structures, formed by relatively narrow, spaced-apart elements, enable the side walls to be flexed for easy application to heels of various sizes, while firmly gripping heels of the smallest size.

11 Claims, 2 Drawing Sheets

STABILIZING AND SUPPORT ACCESSORY FOR STILETTO HEELS

RELATED APPLICATIONS

This application is related to our copending U.S. Application Ser. No. 11/942,087, filed Nov. 19, 2007.

BACKGROUND OF THE INVENTION

Fashionable shoes for women frequently are provided with tall, very narrow heels, sometimes referred to as "spiked" or "stiletto" heels. These heels are very narrow and provide a minimal support surface at the bottom, which can make the shoes difficult to walk in on uneven or soft surfaces. For example, on uneven surfaces, such as cobblestone sidewalks and pavements, cracked and uneven sidewalks, ventilation and drainage grates, etc., stiletto heels can easily tip or snag, potentially causing injury to the wearer of the shoes and/or damage to the heels. Likewise, walking on soft surfaces, such as wet ground, can be very difficult when wearing stiletto-heeled shoes.

As will be readily understood, the bottom surface area of a stiletto heel is quite small, such that the pressure loading on the heel surface is very high. The heels thus can easily penetrate and sink down into soft ground or other soft surfaces, making normal walking very difficult. This problem has been well recognized, and some attempts have been made to provide accessory devices, for temporary attachment to stiletto heels, in an effort to provide greater support and stability. Such prior attempts, insofar as we are aware, have been unsuccessful for a variety of reasons. Prior proposals of the Givens U.S. Pat. No. 1,875,806 and Topel U.S. Pat. No. 5,311,675, are rather large and unwieldy. While providing a large bottom surface area, these designs are otherwise quite impractical.

Other proposals, such as the Grossman U.S. Pat. No. 2,875,534 and the Tilden U.S. Pat. No. 3,150,453 while avoiding the overly large and cumbersome characteristics of the before mentioned patents, are flawed in other ways. The device of the Grossman patent is secured to the heel by folded-over flaps of resilient material, which would provide a tenuous attachment, given the forces acting at the bottom of a stiletto heel during normal walking. The device of the Tilden '453 patent, on the other hand, incorporates an unnecessarily complicated hinged clip arrangement and has other faults. The Fredon patent 3,39,435 utilizes magnetic and/or ring clamp arrangements for holding the device to a heel.

SUMMARY OF THE INVENTION

The present invention relates to a slip-on, slip-off attachment for a stiletto heel, which is inexpensive to manufacture, easy to carry in a purse, and easy to apply to and remove from stiletto heels. The device of the invention is a one-piece molding of a suitable plastic material, such as high density polyethylene (HPDE), which is strong enough and rigid enough to hold its molded shape yet having a sufficient degree of elasticity to enable it to be applied to and grip a heel, for the uses intended, and to be readily removed when not needed.

In accordance with one aspect of the invention, the new heel accessory is constructed as a one-piece injection molding, formed with an hourglass configuration, when viewed in vertical section. The unit has a flat, relatively rigid bottom having a ground-engaging surface formed with a contact area substantially greater than the bottom surface area of the stiletto heel on which it is to be applied. To advantage, a contact area of four or more times the bottom surface area of the heel is provided.

In a particularly preferred embodiment of the invention, opposed front and back walls of the unit are formed with openings of significant size which both provide important functional advantages while reducing the weight and material costs for the unit.

In a preferred form of the invention, opposed side walls of hourglass configuration form a constricted throat area, located in the region of the openings in the front and back walls. The side walls are formed in an arcuate, laterally concave shape to define the throat. Additionally, the front and back edges of the side walls advantageously are of forwardly and rearwardly concave shape respectively. Internally, the side walls are arranged to frictionally grip opposite sides of a stiletto heel, with the side walls having a desirable degree of elasticity in the area of the throat to enable stiletto heels of various sizes to be effectively gripped.

The device of the invention is highly functional for its intended purpose, is attractively designed, and is designed to accommodate economical injection molding production procedures.

For a better understanding of the above and other features and advantages of the invention, reference should be made to the following detailed description of a preferred embodiment and to the accompanying drawings.

DESCRIPTION OF A PREFERRED EMBODIMENT

Figure 3:
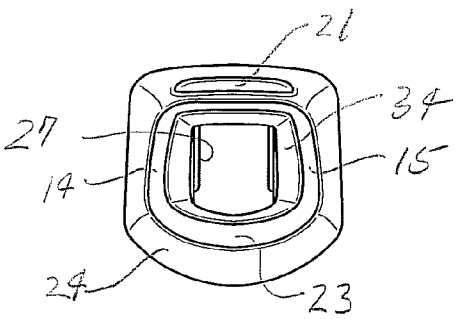
FIG. 3 is a top plan view of the accessory of FIG. 1.

Referring now to the drawings, the reference numeral 10 designates generally a heel accessory device according to the invention. The device 10 advantageously is a one-piece, injection molding of a suitable durable plastic material, such as high density polyethylene (HDPE), which is strong and durable, and sufficiently elastic for the purposes of the invention. The device 10, in a typical embodiment, may have an overall height of about 1.2 inches measured from its ground-engaging surface 11 to the top 12 of its back wall 13. It should be understood, of course, that the foregoing and other dimensions indicated herein are representative of a typical embodiment of the invention, and are not intended to be limiting aspects of the invention except as they may be set forth in the appended claims.

Figure 2:
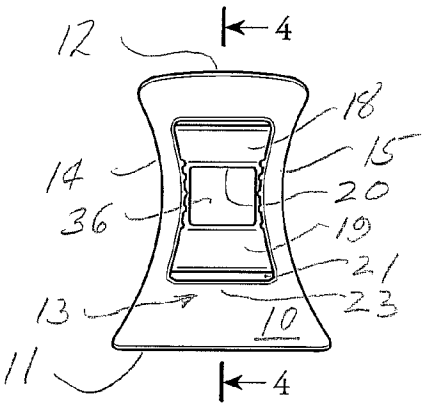
FIG. 2 is a back elevational view of the accessory of FIG. 1.
Figure 5:
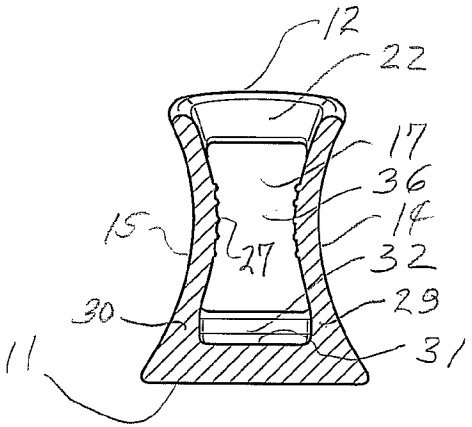
FIG. 5 is a cross sectional view taken generally along line 5-5 of FIG. 4.

In the illustrated form of the invention, the accessory device comprises opposite side walls 14, 15 arcuately formed with an externally concave configuration in a trans-verse direction. The walls 14, 15, which can be of a generally flat form in horizontal section, give the device an hourglass shape as viewed from the front or back as in, for example, FIG. 2 of the drawings. Additionally, the front and back edges of the side walls 14, 15 are of concave shape. According to one aspect of the invention, front and back walls, generally indicated by reference numerals 13, 16 respectively, and which are formed by narrow sections, are connected to portions of the front and back edges of the side walls and thus take on externally concave shape as viewed in vertical cross section in a front-to-back direction. Accordingly, the device also has an hourglass configuration when viewed from the side, as for example, in FIG. 4. Desirably, the thickness of the walls is more or less uniform, such that the internal cavity 17 of the device tends to have an hourglass configuration similar to the external contours of the device. The hourglass configuration forms a constricted throat 36, and an outwardly flaring opening at the top which is of greater width than the constricted throat, as shown in FIGS. 2 and 5, to facilitate mounting of the device onto a stiletto heel.

To advantage, the front wall 16 is comprised of upper and lower sections 18, 19, of limited height as compared to the overall height of the device, extending between and connecting the respective side walls 14, 15 at spaced locations and defining upper and lower front wall openings 20, 21. In a similar manner, the back wall 13 is comprised of a relatively narrow upper back wall section 22, joining the side walls 14, 15 at their upper extremities, and a lower back wall section 23 which extends upward a short distance from the bottom wall 24 of the device. The upper and lower back wall sections 22 and 23 define upper and lower limits of a back wall opening 25 which extends substantially over the full width of the back wall 13, between inside surfaces of the respective side walls 14, 15.

Figure 1:
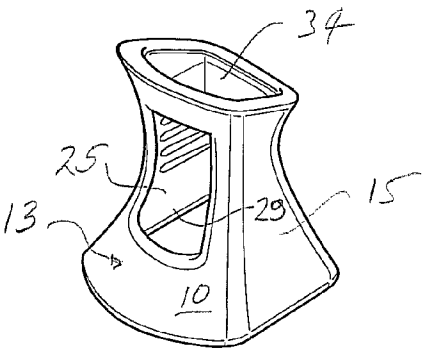
FIG. 1 is a perspective view of a stabilizing support accessory for stiletto heels incorporating principles of the invention.

As can be seen in FIGS. 1 and 3 of the drawings, the upper and lower back wall sections 22, 23 are of externally convex contours in horizontal cross section. The front wall sections 18, 19, on the other hand, preferably are relatively straight in horizontal cross section.

In the illustrated form of the invention, the spaced apart side walls 14, 15 are connected at their back edges only at the top and bottom, which leaves the central or throat section 36 free to flex rather freely inward and outward at least in back portions thereof. Likewise, the front wall opening 20 spans the region of the throat 36, such the front portions of the side walls are also rather free to flex in the region of the throat 36. This enables the device to adapt to a wide variety of heel widths, affording excellent gripping of narrow heels while not unduly resisting application of the device to wider heels.

Figure 4:
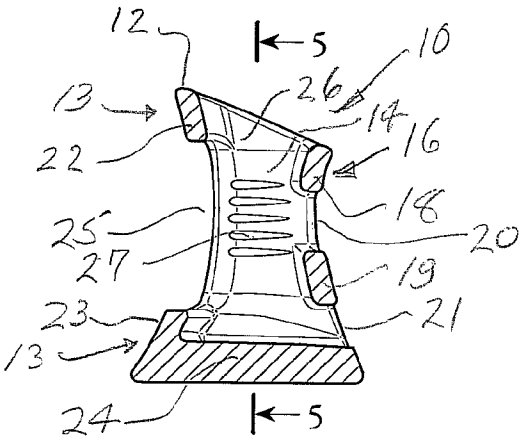
FIG. 4 is a cross sectional view taken generally along line 4-4 of FIG. 2.

As is evident in FIG. 4, the lower edge of the upper back wall section 22 is approximately level with the upper edge of the upper front wall section 18, and the upper edge portions 26 of the opposite side walls angle downwardly from back to front, joining with upper edges of the front and back wall sections 18 and 22. Similarly, the upper edge of the lower back wall section 23 is aligned generally with the lower edge of the lower front wall section 19, as evident in FIG. 4. This configuration, among other things, provides access for the mold elements utilized in the molding procedure. The front and back openings 20, 25 also provide an important level of flexibility to the side walls 14, 15 in the throat region, as explained above, to improve frictional gripping of stiletto heels of all sizes. Desirably, the side walls 14, 15, in the throat area 36, are provided with a plurality of slightly inwardly projecting, horizontal ribs 27 which have frictional contact with the outer surface of a heel 28 on which the device of the invention is applied.

As indicated in FIG. 5, the side walls 14, 15 are of increased thickness in their lower regions 29, 30, located immediately above the upper surface 31 of the bottom wall 24. This is achieved by shaping the lower extremities of the inner side wall surfaces to be non-divergent, as shown in FIG. 5, which reduces the width of the cavity 17 in its lowermost portions 32 to better confine the heel bottom 33 and prevent the accessory device from twisting on the heel.

Figure 6:
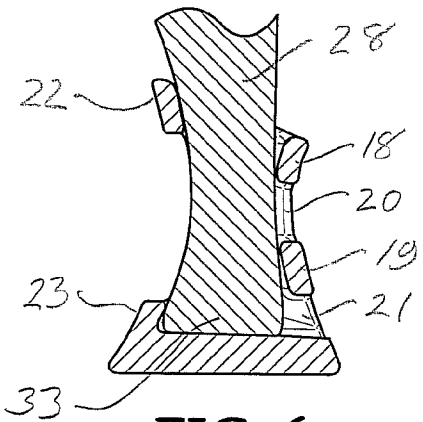
FIG. 6 is a cross sectional view, based on the section of FIG. 4, showing the device of the invention attached to a typical stiletto heel.

When the device of the invention is applied to a heel 28, as shown in FIG. 6, the front wall sections 18, 19 bear against front surface portions of the heel, while the back wall sections 22, 23 bear upon back surfaces of the heel. At the same time, the opposite side walls 14, 15, in the center or throat portions 36 thereof frictionally grip opposite side surfaces of the heel. The device thus firmly grips the heel and provides a high level of stability and support when walking on uneven and/or soft surfaces. In this respect, the area of the bottom surface 11 of the accessory is four or more times the bottom area of the heel itself and provides both a larger support area for walking on soft surfaces, and a better gripping action for walking on uneven surfaces. The bottom surface 11 of the device may advantageously be provided with a suitable tread to increase its gripping effectiveness.

In a representative but not limiting embodiment of the invention, the bottom surface 11 of the device may have an overall width of about 0.93 inch and a front-to-back measurement of approximately 0.94 inch. The back edge of the bottom is of arcuate configuration as indicated in FIG. 3. The top opening 34 of the device may typically have length and width dimensions of about 0.42 inch and 0.51 inch respectively. In the throat area 36, where the internal cavity is of minimum width, the at-rest spacing between the side walls 14, 15 may be on the order of 0.32 inch, somewhat smaller than the minimum width of a stiletto heel expected to be accommodated by the device. However, the significant flexibility of the side walls in the throat area 36 enables the device on to be installed on heels of a great variety of widths much greater than the minimum.

The device of the invention is small and lightweight, and can easily be carried in a woman's purse. The device can be quickly installed by inserting the heel of the shoe into the outwardly flaring top opening, down between the opposed side walls, until the bottom of the heel seats on the upper surface 31 of the bottom wall 24. The opposed side walls 14, 15 easily flex outward, as necessary, to receive the heel, and their resilient pressure against opposite sides of the heel maintain the device securely positioned in the installed position, shown in FIG. 6. The devices can later be quickly removed, when the walking surface is more favorable. Although the devices may be reused many times, if they become soiled with mud, for example, they are sufficiently inexpensive that they can be discarded after removal.

The opposed side walls 14, 15 preferably are of relatively flat section in the front-to-back direction, while having a significant outwardly concave contour in the transverse direction. Inasmuch as these opposed, concave side walls are connected over only limited areas, they easily flex to receive the heel yet maintain a strong grip on the heel throughout use.

The device may be manufactured inexpensively in a variety of attractive colors so as to be readily marketable as a low cost accessory attachment for women's stylish stiletto heeled shoes.

It should be understood, of course, that the specific form of the invention herein illustrated and described is intended to be representative of the basic principles of the invention, and reference should be made to the following appended claims in determining the full scope of the invention.

We claim:

1. A slip-on, slip-off stabilizing and support accessory for a stiletto heel, where the heel has a bottom surface area, which comprises:

(a) a unitary molding of semi-rigid, resilient plastic material having a generally hourglass configuration, as viewed from a front and sides, with an enlarged, relatively rigid flat bottom and an upper portion defining a top opening and a hollow interior for receiving a stiletto heel, (b) said flat bottom forming an internal support surface for engaging, supporting and confining a bottom surface of a stiletto heel, (c) said flat bottom having a downwardly facing ground-engaging surface having a ground contact surface area which is substantially greater than a bottom surface area of said stiletto heel, (d) said accessory having walls of an arcuate, externally concave configuration in a vertical cross section defining a narrowed throat section located between said flat bottom and said upper portion and substantially below said upper portion for frictionally gripping opposed surfaces of said heel, (e) said arcuately configured walls defining an outwardly flaring top opening having a width greater than a width of said narrowed throat section to facilitate insertion of said heel into said hollow interior, (f) internal surfaces of said walls, at a level of said internal support surface, being of a size and shape to confine a bottom extremity of said stiletto heel, (g) external surfaces of said walls, at a level of said flat bottom, being flared outwardly to form a ground contact surface area at least about four times the bottom surface area of said stiletto heel, (h) said walls comprising first and second pairs of opposed walls, (i) said first pair of opposed walls comprising front and back walls, (j) said second pair of opposed walls comprising side walls joined integrally with said front and back walls, (k) internal surfaces of said side walls, in a region of said throat section, comprising gripping surfaces positioned to frictionally engage side walls of said heel, and (l) each of said front and back walls being formed with at least one through opening therein, and at least one of said openings is generally aligned with said throat section.

2. An accessory according to claim 1, wherein a back wall opening is defined by a lower back wall section extending upward a short distance above said internal support surface and defining a lower extent of said back wall opening, and a narrow upper back wall section at an upper end of said accessory connecting upper portions of the opposed side walls and defining an upper extent of said back wall opening.

3. An accessory according to claim 1, wherein (a) openings are formed in said front wall by vertically spaced apart upper and lower narrow front wall sections connecting the opposed side walls, (b) said upper and lower front wall sections define an upper opening in said front wall, (c) said lower front wall section defines an upper extent of a lower opening in said front wall, and (d) said upper opening is generally aligned with said throat section.

4. An accessory according to claim 3, wherein a lower extent of said lower opening in said front wall is defined by said internal support surface.

5. An accessory according to claim 4, wherein a back wall opening is defined by a lower back wall section extending upward a short distance above said internal support surface and defining a lower extent of said back wall opening, and a narrow upper back wall section at an upper end of said accessory connecting upper portions of the opposed side walls and defining an upper extent of said back wall opening.

6. An accessory according to claim 5, wherein (a) an upper edge of said upper front wall section is positioned approximately at a level of a lower edge of said upper back wall section, and (b) a lower edge of said lower front wall section is positioned approximately at a level of an upper edge of said lower back wall section.

7. An accessory according to claim 6, wherein (a) said side walls have upper edge portions connecting upper edge regions of said upper back wall section with upper edge regions of said upper front wall section, (b) said side wall upper edge portions being downwardly inclined in a back to front direction.

8. A slip-on, slip-off stabilizing and support accessory for a stiletto heel, where the heel has a bottom surface area, which comprises:

(a) a unitary molding of semi-rigid, resilient plastic material having a generally hourglass configuration, as viewed from a front and sides, with an enlarged, relatively rigid flat bottom wall and an upper portion defining an outwardly flaring top opening and a hollow interior for receiving a stiletto heel, (b) said flat bottom wall forming an internal support surface for engaging, supporting and confining a bottom surface of a stiletto heel, (c) said flat bottom wall having a downwardly facing ground-engaging surface having a ground contact surface area which is substantially greater than a bottom surface area of said stiletto heel, (d) said accessory having opposed side walls of an arcuate, externally concave configuration as viewed in a vertical cross section taken on a plane disposed transversely to said accessory, said opposed side walls defining a narrowed throat section located between said flat bottom and said upper portion for frictionally gripping opposed surfaces of said heel, said narrowed throat section having a width less than a width of said outwardly flaring top opening, (e) said side walls being connected at back upper edge portions thereof by an upper back wall section having a height less than a height of each side wall, and being connected in back lower portions thereof by a lower back wall section having a height less than the height of each side wall and positioned closely adjacent to said bottom wall, (f) said side walls and said upper and lower back wall sections defining a vertically extending back wall opening to accommodate relatively free lateral flexing of said narrowed throat section of said side walls between said upper and lower back wall sections, (g) said side walls being connected at front edge portions thereof by vertically spaced apart upper and lower front wall sections each having a height less than the height of each side wall, and by said bottom wall, and (h) said upper and lower front wall sections and said bottom wall defining upper and lower openings in a front wall structure of said accessory.

9. An accessory according to claim 8, wherein said side walls are of a generally flat form in a horizontal cross section and are of a generally hourglass configuration in a front-to-back direction, defined by forwardly concave front edges and rearwardly concave back edges.

10. An accessory according to claim 8, wherein (a) an upper edge of said upper front wall section is substantially level with or below a lower edge of said upper back wall section, and (b) a lower edge of said lower front wall section is substantially level with or above an upper edge of said lower back wall section.

11. An accessory according to claim 8, wherein (a) said side walls are of a generally hourglass internal configuration, with outwardly divergent portions below said narrowed throat section, and (b) lower extremities of said divergent side wall portions are of a non-divergent shape resulting in an increased thickness of said side wall portions closely adjacent to said bottom wall to provide close confinement for the bottom of a heel inserted into said accessory.

* * * * *